United States Patent [19]

Fox

[11] 4,073,279

[45] Feb. 14, 1978

[54] INTERNAL COMBUSTION ENGINE SHUT-OFF DEVICE

[75] Inventor: Wayne S. Fox, Jordan, Minn.

[73] Assignee: Kawasaki Motors Corporation, U.S.A., Santa Ana, Calif.

[21] Appl. No.: 683,794

[22] Filed: May 6, 1976

[51] Int. Cl.[2] ..... F02B 77/00

[52] U.S. Cl. ..... 123/198 DC; 123/148 E; 123/148 S

[58] Field of Search ..... 123/198 DC, 198 D, 148 S, 123/148 CC, 149 A, 149 R, 148 E

[56] References Cited

U.S. PATENT DOCUMENTS

| | | | |
|---|---|---|---|
| 3,680,539 | 8/1972 | Savage et al. | 123/198 DC X |
| 3,703,889 | 11/1972 | Bodig et al. | 123/198 DC X |
| 3,726,265 | 4/1973 | Howard | 123/198 DC X |
| 3,914,735 | 10/1975 | Guillaume | 123/198 D X |
| 3,960,128 | 6/1976 | Anderson et al. | 123/198 DC |
| 3,964,461 | 6/1976 | Wesemeyer et al. | 123/198 DC |

*Primary Examiner*—Charles J. Myhre
*Assistant Examiner*—Ira S. Lazarus
*Attorney, Agent, or Firm*—Dorsey, Windhorst, Hannaford, Whitney & Halladay

[57] ABSTRACT

A shut-off device for use with an internal combustion engine having an electric ignition comprises a switch having first and second states, connected to the engine ignition in such a way that the ignition current is not inhibited when the switch is in its first state but is inhibited when the switch is in its second state. The device further has means for changing the switch from its first state to its second state and means for automatically maintaining the switch in its second state for a predetermined interval of time sufficient to allow the engine to die.

15 Claims, 3 Drawing Figures

INTERNAL COMBUSTION ENGINE SHUT-OFF DEVICE

BACKGROUND OF THE INVENTION

1. Field of the Invention

The present invention relates to internal combustion engine controls and, more particularly, to a device for shutting off an internal combustion engine by inhibiting the ignition current. The device is instantaneously operable and resets itself automatically to a non-inhibiting condition when the engine is no longer running, so that the engine may be restarted without manually resetting the shut-off device.

2. Description of the Prior Art

Many vehicles, such as snowmobiles, motorcycles and minibikes, and many types of mechanical equipment, such as lawnmowers, outboard motors, snowblowers and portable generators, are powered by internal combustion engines. When the operator of such a vehicle or machine wishes to shut off the engine, he usually activates a shut-off control which inhibits delivery of ignition current to the spark coil or spark plugs. Thus, while fuel may still be fed into the combustion chamber, it is not ignited, and the motor soon dies. Shut-off controls conventionally used are basically of two types. In one type, a switch is manually activated which grounds or otherwise interrupts or inhibits the ignition circuit, effectively killing the engine without further operator attention. In the second type, the shut-off switch also inhibits the ignition circuit, but the switch must be attended to until the operator is sure the engine has died.

The first type of shut-off switch has the disadvantage that it must typically be reset before the engine can be restarted. Should the operator neglect to do this, he may flood the engine before he realizes his error and restores the ignition system to its non-inhibited state. In addition, when the vehicle or machine is operated in the dark it is difficult to tell whether the "push-push" or slide type shut-off switches conventionally used to control the device have been reset for starting or not. If the state of the switch is not properly determined before restarting, flooding the engine is again possible.

With the second type of shut-off switch, resetting of the switch before the next start is typically unnecessary because the switch has no ignition-inhibiting effect when the operator ceases tending it. However, continued operator attention is usually required until the engine fully dies. This makes it difficult or impossible to shut off the engine quickly in emergency situations where the operator is forced to leave the vehicle or machine.

SUMMARY OF THE INVENTION

The present engine shut-off device overcomes the disadvantages of these two conventional types of shut-off controls, by providing a shut-off device which is instantaneously activated and causes shut-off without further operator attention. The device also resets itself automatically after an interval sufficient to ensure that the engine has died, thus permitting restarting without further manipulation of the shut-off device. According to the present invention, a shut-off device for use with an internal combustion engine having an electric ignition comprises: a switch having a first state and a second state; means connecting said switch to the ignition of the engine so that the ignition current is not inhibited when the switch is in its first state and is inhibited when the switch is in its second state; means operatively connected to the switch for causing the transition from the first state to the second state; and means operatively connected to the switch for automatically maintaining the switch in its second state for a predetermined interval of time sufficient to allow the engine to cease operation.

Accordingly, it is an object of the present invention to provide an improved internal combustion engine shut-off device which, after momentary activation by an operator, will proceed to shut off the engine without further operator intervention.

It is another object of the present invention to provide an improved internal combustion engine shut-off device which automatically resets itself after engine shutdown, so that no further operator action is necessary before the next start.

These and other objects will become apparent with reference to the drawings, the description of the preferred embodiment and the appended claims.

DESCRIPTION OF THE PREFERRED EMBODIMENT

Figure 1:
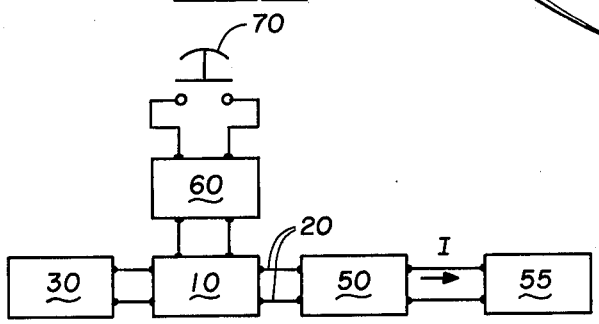
FIG. 1 is a schematic, function block drawing of the shut-off device, indicating its connection to the engine ignition system.

The device of the present invention, as shown schematically in FIG. 1, comprises generally, a switch 10, having a first state and a second state, operatively connected by means 20 to the ignition system 50 of an internal combustion engine (not shown), in such a manner that the ignition current I feeding the sparking or igniting element 55 is not inhibited when the switch 10 is in its first state and is inhibited when the switch 10 is in its second state. Means 30 for maintaining the switch 10 in its second state for a predetermined time interval are operatively connected to the switch 10, as are means 60 for initiating the transition of the switch 10 from its first state to its second state. A momentary switch 70, preferably a momentary push switch, providing for operator activation of the device, is connected to the means 60 for initiating the switch transition.

The operation of the device schematically shown in FIG. 1 can be explained as follows. During normal operation of the engine the switch 10 is in its first state where in the ignition current I is not inhibited. Momentary closing of the push switch 70 activates the means 60 for initiating the transition of switch 10 from its first state to its second state, thereby causing inhibition of the ignition current I. Means 30 for automatically maintaining the switch 10 in its second state ensures that the ignition current I remains inhibited for a predetermined time interval T, chosen to be of sufficient duration that the engine ceases operation. At the end of the time interval T the means 30 for maintaining the switch in its second state terminates its function, allowing the switch 10 to return to its first state. The ignition current I is, therefore, no longer inhibited, and the engine can be restarted in the normal way.

Figure 2:
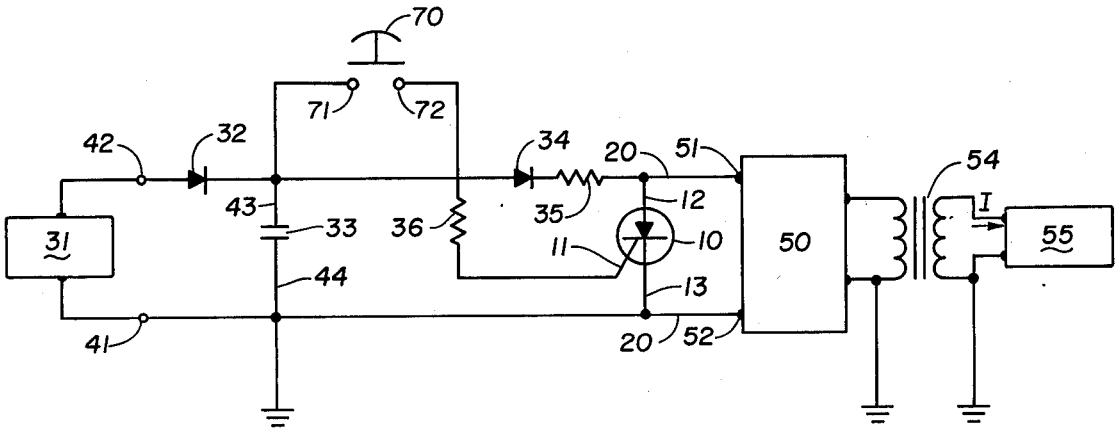
FIG. 2 is a wiring diagram of the circuitry of the preferred embodiment of the shut-off device, indicating its connection to an alternating current source and the engine ignition system.

FIG. 2 shows a wiring and component diagram of the preferred embodiment of the present invention. The switch 10 is a silicon controlled rectifier (SCR) with a gate terminal 11 and anode and cathode terminals 12 and 13, respectively. A pair of wires 20 connects the anode and cathode terminals 12, 13 of the SCR 10 to the ignition system 50. In the preferred embodiment shown in FIG. 2 the anode and cathode terminals 12, 13 of the SCR 10 are connected in parallel with the input terminals 51, 52 of a capacitive discharge ignition system 50 which, in turn, is connected to the spark plugs 55 via the spark coil 54. The circuit network consisting of an alternating current source 31, a rectifying diode 32, a capacitor 33, a blocking diode 34, a time constant resistor 35 and a gate resistor 36, together with a momentary switch 70, preferably a momentary push switch, serves as the means for initiating the transition of the SCR 10 from a first, non-conducting state to a second, conducting state. The circuit network serves also as the means for maintaining the SCR 10 in its second, conducting state for a predetermined interval of time T.

As shown in FIG. 2 the elements of the circuit of the present invention are connected in the following way. A first terminal 41 of an alternating current source 31, such as a magneto, is connected to a ground voltage level, preferably a chassis ground, along with the ground terminal 44 of the capacitor 33, the cathode terminal 13 of the SCR 10 and the grounded input terminal 52 of the capacitive discharge system 50. The second terminal 42 of the alternating current source 31 is connected to the anode of the rectifying diode 32, while the cathode of the rectifying diode 32 is connected together with a first terminal 71 of the momentary push switch 70, the anode of the blocking diode 34 and the positive terminal 43 of the capacitor 33. The momentary push switch 70, having a first terminal 71 and a second terminal 72, and the gate resistor 36 form a series combination linking the gate terminal 11 of the SCR 10 with the cathode of the rectifying diode 32, the anode of the blocking diode 34 and positive terminal 43 of the capacitor 33. The blocking diode 34 and the time constant resistor 35 form a series combination linking the anode terminal 12 of the SCR 10 and the positive input terminal 51 of the capacitive discharge system 50 with the cathode of the rectifying diode 32, the positive terminal 43 of the capacitor 33 and the first terminal 71 of the momentary push switch 70.

Figure 3:
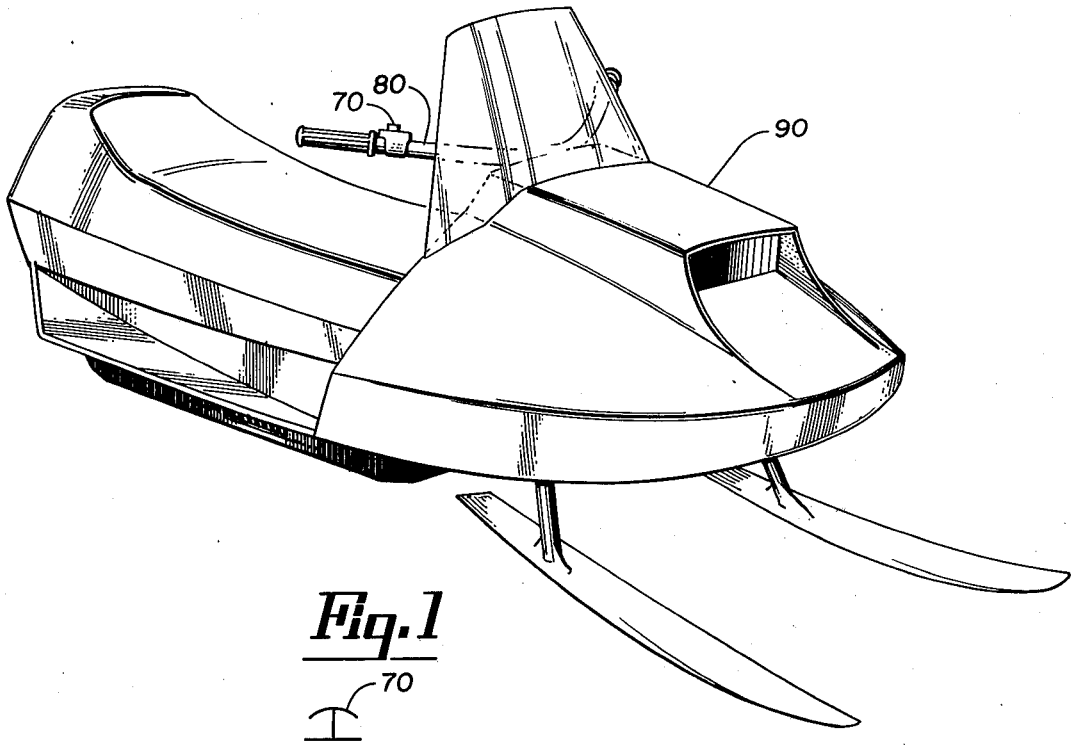
FIG. 3 is a view showing the device of the present invention as it is used in connection with a snowmobile.

The circuit elements 10, 32, 33, 34, 35 and 36, of the present invention will preferably be built as one unit and may be located practically anywhere on the vehicle or machine with which the present device is used, although the location should be chosen for ease of access during servicing of the unit and to facilitate its connection with the momentary push switch 70, the alternating current source 31 and the capacitive discharge ignition system 50. The momentary push switch 70, which is preferably not part of the unit formed by the other circuit elements, should be located within easy reach of the operator, preferably near other controls. FIG. 3 shows the preferred location of the push switch 70 on the handlebars 80 of a snowmobile 90.

While circuit elements having a wide variety of values and specifications can be used to build the circuit of the present invention, the following components have been found particularly suitable for the preferred embodiment of the present invention as adapted to be used on a snowmobile. The basic switch element, the SCR 10, is a Motorola MCR 107-6 or equivalent. The blocking diode 34 and the rectifying diode 32 are of the same type; both are semiconductor diodes rated at 1 ampere and 400 peak inverse volts, such as device number IN4004. The capacitor 33 is an electrolytic capacitor rated at 500 microfarads, 50 working volts DC. The gate resistor 36 has a value of 15 kilohms, while the time-constant resistor 35 is 6.2 kilohms. Both resistors are rated at one-fourth watt. In addition, the lighting coil of the snowmobile has been found to be suitable as the source of alternating current 31.

The operation of the circuit shown in FIG. 2 is as follows. In normal running operation of the engine, alternating current delivered to the diode 32 is rectified and fed to the capacitor 33. Charging of the capacitor 33 by this rectified current occurs almost immediately on starting the engine, and the charge is retained while the engine runs. During starting and normal running of the engine, the SCR 10 remains in its non-conducting state, since the momentary push switch 70 is open, and no triggering current has been delivered to the gate terminal 11. When the operator depresses the momentary push switch 70 to shut off the engine, current travels from the capacitor 33 across the momentarily closed push switch 70 and the gate resistor 36 to the gate terminal 11 of the SCR 10. Since the push switch 70 is closed for only a short interval, only a small pulse of current travels to the gate 11. This pulse is effective to change the SCR 10 from its non-conducting to its conducting state, causing a short-circuit between the anode terminal 12 and the cathode terminal 13. As a result, the input terminals 51, 52 of the capacitive discharge ignition 50 are shorted together, and no ignition current pulses are produced to feed the spark coil 54 and the spark plugs 55. With the SCR 10 now in its conducting state, current flows from capacitor 33 via the blocking diode 34 and the time constant resistor 35 through the SCR 10 to ground. This current is, initially, larger than the SCR's holding current and therefore maintains the SCR 10 in its conducting state. Due to the extremely large input impedance of the capacitive discharge ignition 50, virtually all the current from the capacitor flows through the SCR 10, with only negligible leakage into the ignition. With the ignition inhibited and no combustion occurring, the alternating current source 31 delivers less and less current to the capacitor 33. Accordingly, the total charge of the capacitor 33 decreases, as does the current flowing through the SCR 10. The rate of decrease of the charge and the current through the SCR 10 is determined by the circuit time constant $T_D = RC$ (according to the well known formulas for charge decay in a resistor-capacitor circuit) and by the decreasing charging current from the alternating current source 31. In the present circuit R is the resistance value of the time-constant resistor 35 while C is the capacitance of the capacitor 33.

After 15 to 20 seconds the charge on the capacitor 33 has decreased to the extent that the current delivered to the SCR 10 becomes less than the SCR's holding current; therefore, the SCR 10 stops conducting and becomes again an open circuit between the anode and cathode terminals 12, 13. The capacitive discharge ignition 50 is no longer shorted out and the ignition current I is no longer inhibited. Accordingly, the engine can be restarted if desired.

In normal running operation, before the operator begins shut-off, the blocking diode 34 is non-conducting and functions to prevent large voltage pulses which may be leaked by the capacitive discharge system 50 from traveling into the remainder of the circuit. The gate resistor 36 in series with the momentary push switch 70 serves a dual function. First, it desensitizes the SCR 10 with respect to stray current pulses or noise which might reach the gate terminal 11 and inadvertently trigger the SCR 10 into its conducting state when no shut-off is desired. Secondly, it also serves to moderate current pulses flowing into the gate terminal 11 of the SCR 10, thereby protecting the SCR 10 against large current pulses which might burn it out.

Although the description of the preferred embodiment has been quite specific, it is contemplated that various modifications of the device disclosed herein could be made without deviating from the spirit of the invention. Thus, it is intended that the scope of the present invention can be dictated by the appended claims rather than by the preferred embodiment described above.

What is claimed as new and desired to be secured by Letters Patent of the United States is:

1. A shut-off device for an internal combustion engine having an electric ignition, said device comprising:

switching means having a first state and a second state;

means connecting said switching means to the ignition of the engine so that the ignition current is not inhibited when the switching means is in its first state and is inhibited when the switching means is in its second state;

means operatively connected to the switching means for causing a transition from the first state to the second state; and means operatively connected to the switching means, for automatically maintaining the switching means in its second state for a predetermined interval of time sufficient to allow the engine to cease operation.

2. The shut-off device recited in claim 1 further comprising a momentary switch for activating the means for causing a transition, said momentary switch being operatively connected to said means for causing a transition.

3. The shut-off device recited in claim 1 wherein the switching means having a first state and a second state is a silicon controlled rectifier.

4. A shut-off device for an internal combustion engine of the type having a capacitive discharge electric ignition, said device comprising:

a silicon controlled rectifier having conducting and non-conducting states, and gate, anode and cathode terminals;

means connecting the anode and cathode terminals of the silicon controlled rectifier in parallel with the charging input terminals of the capacitive discharge ignition;

means for delivering an electrical pulse to the gate terminal of the silicon controlled rectifier, said pulse being effective to change the silicon controlled rectifier from a non-conducting state to a conducting state; and a time-controlled energy source operatively connected to the silicon controlled rectifier for maintaining the silicon controlled rectifier in its conducting state for a predetermined interval of time sufficient to allow the engine to cease operation.

5. The shut-off device recited in claim 4 wherein the means for delivering an electrical pulse to the gate terminal of the silicon controlled rectifier comprises:

a momentary switch;

a capacitor operatively connected via the momentary switch to the gate terminal of the silicon controlled rectifier; and means for supplying a current for charging said capacitor.

6. The shut-off device recited in claim 5 wherein the means for delivering an electrical pulse to the gate terminal of the silicon controlled rectifier further comprises a resistor connected in series with the capacitor and the momentary switch.

7. The shut-off device recited in claim 5 wherein the means for supplying a current for charging said capacitor comprises a series combination of an alternating current source and a rectifier, said current source-rectifier series combination being connected in parallel with said capacitor.

8. The shut-off device recited in claim 5 wherein the momentary switch is a momentary push switch.

9. The shut-off device recited in claim 4 wherein the means for delivering an electrical pulse to the gate terminal of the silicon controlled rectifier comprises:

an energy source; and a momentary switch operatively connecting said energy source to the gate terminal of the silicon controlled rectifier.

10. The shut-off device recited in claim 9 wherein the means for delivering an electrical pulse to the gate terminal of the silicon controlled rectifier further comprises a resistor connected in series with the gate terminal of the SCR and said momentary switch.

11. The shut-off device recited in claim 9 wherein the momentary switch is a momentary push switch.

12. The shut-off device recited in claim 4 wherein the time controlled energy source comprises:

a combination of a capacitor and a resistor, said capacitor-resistor combination being operatively connected with the terminals of the silicon controlled rectifier such that a charge on the capacitor serves to maintain said silicon controlled rectifier in its conducting state for said predetermined interval of time; and means for supplying a current for charging said capacitor.

13. The shut-off device recited in claim 12 wherein the means for supplying a current for charging said capacitor comprises a series combination of a current source and a rectifier, said current source-rectifier series combination being operatively connected to said capacitor.

14. A shut-off device for an internal combustion engine of the type having a capacitive discharge electric ignition, said device comprising:

a silicon controlled rectifier having conducting and non-conducting states, and gate, anode and cathode terminals;

means connecting the anode and cathode terminals of the silicon controlled rectifier in parallel with the charging input terminals of the capacitive discharge ignition;

means for delivering an electrical pulse to the gate terminal of the silicon controlled rectifier, said pulse being effective to change the silicon controlled rectifier from a non-conducting state to a conducting state; and a time controlled energy source operatively connected to the silicon controlled rectifier for maintaining the silicon controlled rectifier in its conducting state for a predetermined interval of time sufficient to allow the engine to cease operation, said energy source including a series combination of a capacitor and a resistor, said capacitor-resistor series combination being connected in parallel with the anode and cathode terminals of the silicon controlled rectifier, and further including means for supplying a current for charging said capacitor.

15. The shut-off device recited in claim 14 wherein the means for supplying a current for charging said capacitor comprises a series combination of an alternating current source and a rectifier, said current source-rectifier series combination being connected in parallel with said capacitor.

* * * * *